United States Patent [19]

Meredith

[11] Patent Number: 4,889,966

[45] Date of Patent: Dec. 26, 1989

[54] APPARATUS FOR HEATING DISCRETE PACKAGES OF PRODUCTS USING MICROWAVES

[75] Inventor: Roger J. Meredith, Rutland, England

[73] Assignee: APV Magnetronics Limited, Leicester, England

[21] Appl. No.: 228,575

[22] Filed: Aug. 5, 1988

[51] Int. Cl.[4] ..... H05B 6/74

[52] U.S. Cl. ..... 219/10.55 F; 219/10.55 A; 219/10.55 E; 99/451

[58] Field of Search ..... 219/10.55 F, 10.55 A, 219/10.55 R, 10.55 E, 10.55 M; 99/451, DIG. 14

[56] References Cited

U.S. PATENT DOCUMENTS

| | | | |
|---|---|---|---|
| 3,211,880 | 10/1965 | Johnson | 219/10.55 F |
| 3,397,296 | 8/1968 | Curran | 219/10.55 F |
| 3,461,260 | 8/1969 | Bremer | 219/10.55 F |
| 3,478,187 | 11/1969 | Agdur et al. | 219/10.55 A |
| 3,578,463 | 5/1971 | Smith et al. | 219/10.55 M |
| 3,851,132 | 11/1974 | Van Koughnett | 219/10.55 A |
| 4,144,434 | 3/1979 | Chiron et al. | 210/10.55 F |
| 4,289,945 | 9/1981 | Kristof | 219/10.55 F |
| 4,683,362 | 7/1987 | Yangas | 219/10.55 F |

*Primary Examiner*—Philip H. Leung

*Attorney, Agent, or Firm*—Charles E. Brown; Charles A. Brown

[57] ABSTRACT

Microwave apparatus for heating discrete packages (12) of product. The microwave apparatus has a support surface (14) for a packaged product within a waveguide (2), a microwave field generator, and field deflecting and concentrating guide (4,6) to produce a raised value of energy in the field in the interior region of the package so as to uniformly heat the package (12).

8 Claims, 2 Drawing Sheets

APPARATUS FOR HEATING DISCRETE PACKAGES OF PRODUCTS USING MICROWAVES

BACKGROUND OF THE INVENTION

The invention is concerned with heating apparatus, particularly microwave heating apparatus.

This type of apparatus is used extensively for the heating, thawing or cooking of foods including pre-packaged food portions. In the context of the heating of pre-packaged food portions in large quantities it is essential to ensure that the heating is uniform not only between individual packaged portions but also within each portion.

It is well known that microwave ovens of the multimode type do not achieve satisfaction uniformity of heating for the following reasons:

1. Multiple reflections from the walls of the oven create standing waves of voltage stress which give rise to a pattern of hot spots.

2. As the microwave field enters the product it is attenuated by the power absorption and consequently may be reduced to a low intensity by the time it has penetrated to the central interior of the product.

3. The high dielectric constant of the product causes total internal reflection resulting in energy being "trapped" inside the product and causing standing waves within it.

Moreover the high dielectric constant of most food products creates refraction causing preferential heating along the edges and particularly at corners of three dimensional projections.

Where continuous flow of heating of discrete objects is required, it has been found that a multimode oven cannot provide the required degree of uniformity usually required in an industrial process, e.g. in the pasteurisation of food products it is essential that the temperature shall reach at least a minimum value to achieve the required low bacterial count but the temperature should not reach a value at which the product is cooked or in an extreme case partially dried. Other products may partially melt or decompose to create off-flavours if the temperature exceeds a modest maximum. This means that the energy input must be uniform with a range +/−2% to +/−10% from point to point within the product, depending upon the precise requirements.

SUMMARY OF THE INVENTION

The object of this invention is to provide a continuous flow tunnel in which microwave energy is injected to heat the product in a uniform manner.

The invention therefore provides microwave apparatus for heating discrete packages of product comprising a support surface for a packaged product within a waveguide, means to provide a microwave field, and field deflecting and concentrating guide means to produce a raised value of energy in the field in interior regions of the packaged product as selected.

Where a series of packaged products are to be heated, the support surface may advantageously be a conveyor device.

Preferably the guide means may be in the form of at least two mutually confronting vanes. The microwave field may be directed at, for example, the base of the packaged product, edges of the package being partially shielded from the field.

An application of particular interest is in the heating of at least substantially rectangular boxes of food which would be on retail sale in a chilled food cabinet held at 4° C. The products have a better customer appeal that deep-frozen products of the same kind as they have an image of freshness. However the rate of bacterial growth at or about 4° C. is fairly rapid and normally a shelf-life of a few days only can be expected. By microwave pasteurisation to a temperature of 85° C. the shelf life can be extended to several weeks with obvious commercial adantages in retailing and distribution. The boxes typically contain such products as lasagne, spaghetti bolognese, boeuf bourgignon, fish with vegetables, meat with vegetables, curry and the like.

Passing boxes containing the above meals through a simple microwave tunnel ordinarily results in temperature profiles which have a minimum of 40° to 50° C. in the centre with peak temperatures in corners and edges of over 90° C. and clearly this would be unacceptable.

In an example to be described, the packaged product portions are passed on a conveyor band through a rectangular waveguide operating in the HO1 mode such that the electric field is horizontal and parallel to the plane of the bottom of each package (box) and the box is located so that its mean height is substantially at the centre plane of the waveguide where the electric field has its maximum value.

In this simple configuration a train of boxes passing through the tunnel would have low temperatures at the centre of the boxes and high temperature at the corners and particularly in the centres of the leading and trailing edges.

There will now be described, with reference to the drawings, examples of apparatus according to the invention. It will be understood that the description is given by way of example only and not by way of limitation.

BRIEF DESCRIPTION OF THE DRAWINGS

In FIG. 1 is shown a rectangular waveguide 2, in accordance with the invention, in which a pair of vanes 4,6 are introduced which serve to concentrate the microwave field between their opposing faces 8,10 so that additional energy is injected through the base of the boxes 12 which are supported on a conveyor band 14. The vanes 4, 6 are so shaped that they shield the outer edges of the boxes 12 from the microwave field to a limited extent so that some heating occurs and by adjustment of the proportions of the vanes, distances a & b in FIG. 1, equality of energy distribution can substantially be achieved.

In tests conducted with packaged portions of Spaghetti Bolognese, a temperature variation of +/−1.5° C. has been achieved in a train of boxes starting from a temperature of 15° C. with a final temperature of 85° C. This is entirely adequate for the pasteurisation process and leaves some margin for design in which the conveyor band 14 passes over the vanes to form a plain conveyor to carry a train of boxes through a simple uncluttered tunnel.

The margins of the vanes may be shrouded in a dielectric sheath 16 which provides clearance between the vane edge and the box and avoids extremely localised high intensity heating which can cause local burning in a line along the bottom of the boxes. The vane edges may also have a circular section conductor (not shown) which serves to reduce localised voltage stresses.

The vanes extending along the length of the waveguide may in an alternative example by a skeleton form in which a plurality of supports radiating from the side of the waveguide supports a continuous or semi-continuous bar, to give the required field distribution.

While the example described above only includes a single pair of vanes, it will be appreciated that the number, shape, position and orientation of the vanes can be varied to achieve the required heating effect and that this may be achieved by the provision of a non-uniform field in the waveguide.

Various examples of suitable arrangements will be described below but the individual features mentioned in each case can be combined to achieve the desired result.

Figure 1:
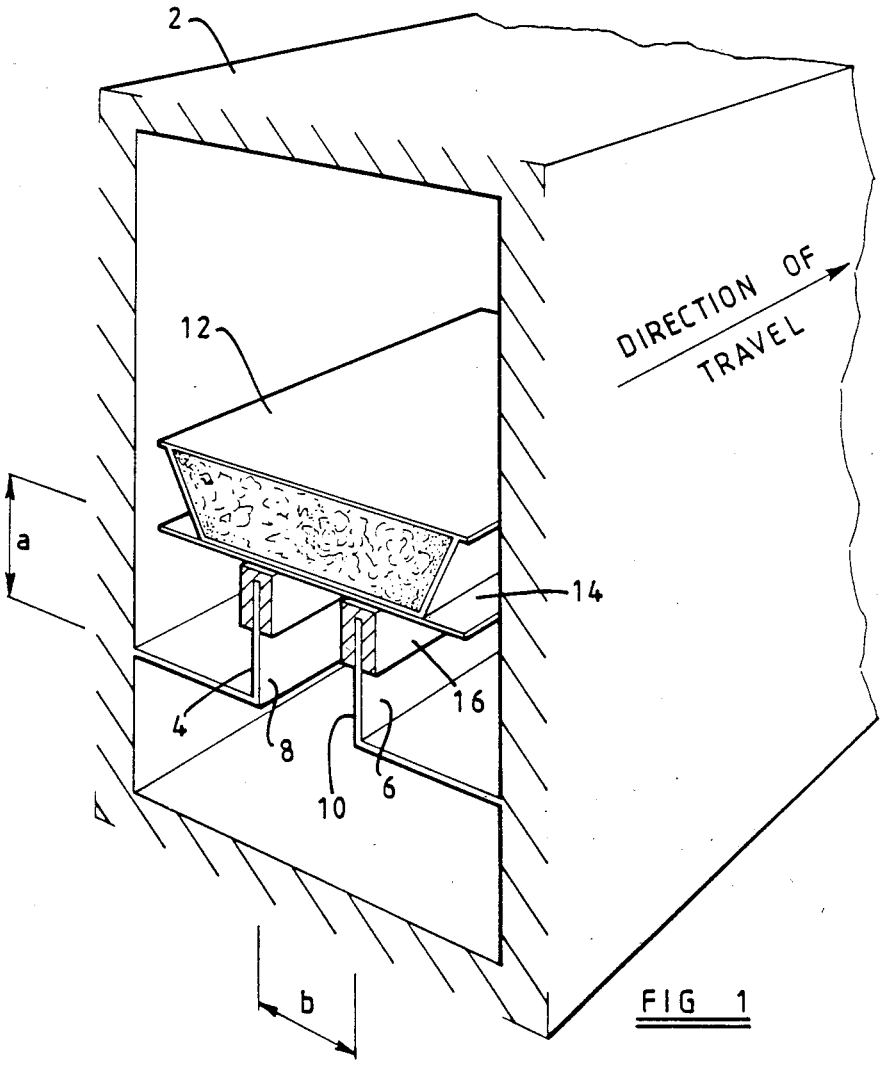
FIG. 1 shows a cross section through apparatus according to one embodiment of the present invention.
Figure 2:
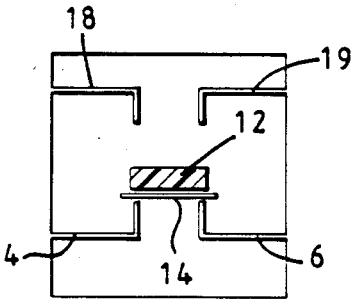
FIGS. 2–5 shows schematic cross-sections of alternative arrangements according to the invention.
Figure 3:
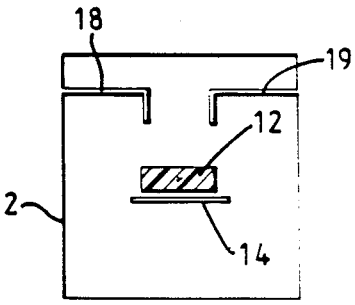
Figure 4:
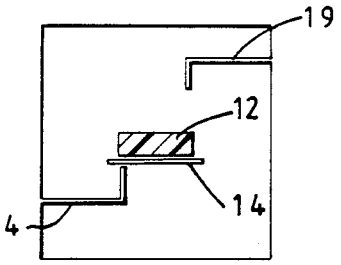
Figure 5:
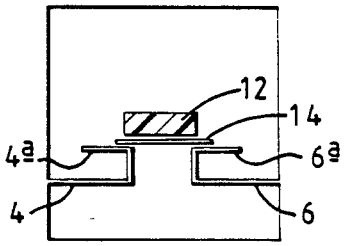

Referring now to FIGS. 1–8, the schematic views shown therein illustrate possible variations to achieve the desired result. In FIG. 2, a further pair of opposed waveguides 18,19 are provided above the conveyor 14. The alternative arrangement shown in FIG. 3 comprises a single pair of overhead vanes, 18,19, the lower vanes 4,6 being omitted. It is also not necessary that the vanes be provided in opposing pairs and FIG. 4 illustrates an arrangement in which one vane 4 is below the conveyor 14 and a second vane 19 is above.

The vanes 4,6,18,19 have been shown as L-shaped but it is also possible that other shapes can be used such as quadrantare of circle, non-right angle on other configurated shapes. In one alternative (FIG. 5) the vanes 4,6, include an outwardly directed flange portion **4*a*,6*a*, the conveyor 14 sliding across these portons. In this case, a dielectric slab is provided on the flange portions 4*a*,6*a*** to prevent burning.

Figure 6:
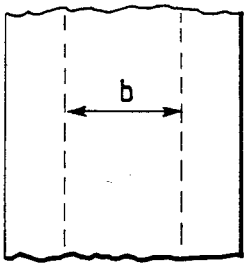
FIGS. 6–8 shows schematic plan views of sections of apparatus according to further embodiments of the invention.
Figure 7:
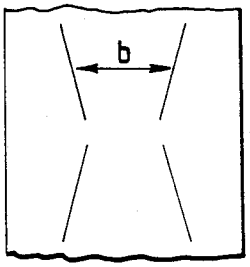
Figure 8:
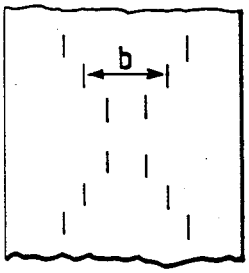

The plan views shown in FIG. 6–8 are examples of the longitudinal arrangement of the vanes. As can be seen, the vanes can be separated into short lengths and the separation (dimention b) of these lengths can be constant or vary.

The application of the microwave energy can be varied according to the power requirements. Underneath an overhead T junction arrangement can be used with baffle plates to achieve the appropriate microwave deflection along the waveguide. Furthermore, slotted waveguides or directional couplers can be used where the total power requirement is high but where the power cannot be applied all at once due to the danger of sparking in the waveguide. As an alternative, a plurality of separate heating steps can be used. It is also desirable to inject hot air or steam into the conveyor tunnel to reduce heat loss from the article being heated. Typically the temperature inside the tunnel is raised to at least 50° C.

Although the arrangements described above are intended to produce a suitable heating profile, it can be desirable to include a heating section which has no vanes as there may otherwise be overcompensation in the tunnel.

The various arrangements described above are illustrations of the manner in which the objects of the invention can be achieved. The arrangements can be combined in any manner to achieve the required heating profile depending upon the size and nature of the article being heated.

The microwave frequency range over which the device may operate is preferably in the range 800–1300 MHz but the technique is applicable over the range 100–10,000 MHz and above.

I claim:

1. A microwave apparatus for heating a discrete package of a product comprising a microwave field generator for generating a microwave field of energy, an elongate waveguide being connected to said generator, means being attached to said waveguide for supporting and axially moving the package through the waveguide, means beng attached to said waveguide for deflecting and concentrating the microwave field, said waveguide being arranged to propogate microwave energy from said generator such that the electronic field of the microwave energy is substantially transverse to the direction of propogation, and said deflecting and concentrating means being arranged to produce a raised value o energy within the interior of the package and ensure uniform heating thereof.

2. The microwave apparatus as claimed in claim 1, wherein said deflecting and concentrating means comprises at least one vane member located within said waveguide, said vane member is shaped and positioned so as to provide the required microwave field characteristics.

3. The microwave apparatus as claimed in claim 2, wherein a dielectric sheath is attached to a portion or portions of said one or more vanes.

4. The microwave apparatus as claimed in claim 1, wherein said support means comprises a conveyor device located within said waveguide for conveying the package generally axially therethrough.

5. The microwave apparatus as claimed in claim 4, wherein said deflecting and concentrating means comprises vane members located within said waveguide above and below said conveyor device so as to provide the required microwave field characteristics in a package on said conveyor device.

6. The microwave apparatus as claimed in claim 1, wherein the connection between said microwave generator and said waveguide allows microwave energy to be admitted to the waveguide at one or more separate locations.

7. The microwave apparatus as claimed in claim 6, wherein a slotted waveguide or a directional coupler is used to admit microwave energy to said waveguide.

8. The microwave apparatus as claimed in claim 1, wherein an air heater or steam generator is also connected to the waveguide, and means being provided for introducing hot air or steam into the waveguide.

* * * * *